US006128996A

United States Patent [19]

Sato et al.

[11] Patent Number: 6,128,996

[45] Date of Patent: Oct. 10, 2000

[54] FOOD HOLDER FOR SLICING FOOD INTO TWO PIECES

[75] Inventors: Katsunori Sato, Sumoto; Shigehiro Uemura, Kyoto, both of Japan

[73] Assignee: Sanyo Electric Co., Ltd., Moriguchi, Japan

[21] Appl. No.: 09/217,208

[22] Filed: Dec. 22, 1998

[30] Foreign Application Priority Data

Dec. 25, 1997 [JP] Japan ..... 9-356957

[51] Int. Cl.[7] ..... B26D 7/02; B25B 1/20

[52] U.S. Cl. ..... 83/765; 83/454; 83/458; 83/459; 83/464; 83/466; 83/466.1; 269/87.2; 269/227

[58] Field of Search ..... 83/762, 932, 763, 83/764, 765, 454, 458, 459, 460, 464, 466, 466.1; 269/227, 34, 87.2

[56] References Cited

U.S. PATENT DOCUMENTS

| | | | |
|---|---|---|---|
| 789,889 | 5/1905 | Sutherland | 83/464 |
| 2,904,087 | 9/1959 | Walthall | 269/227 X |
| 4,399,989 | 8/1983 | Baillie | 83/762 X |
| 5,361,666 | 11/1994 | Kensrue | 83/762 X |
| 5,486,259 | 1/1996 | Goodwin et al. | 269/227 X |
| 5,638,734 | 6/1997 | Fish | 83/762 |
| 5,673,608 | 10/1997 | DeMars | 83/762 X |
| 5,690,013 | 11/1997 | Kanarek et al. | 83/762 |
| 5,718,158 | 2/1998 | Rogge | 83/762 |
| 5,946,998 | 9/1999 | Thompson | 83/762 X |

*Primary Examiner*—Rinaldi I. Rada
*Assistant Examiner*—Charles Goodman
*Attorney, Agent, or Firm*—Wenderoth, Lind & Ponack, L.L.P.

[57] ABSTRACT

The food holder has two vertical plates, mounted on a base vertically and parallel to each other. The two plates create a gap between the plates where food is held. Knife guides with vertically extending guide slits are provided at both ends of the gap. The two vertical plates are connected to the base in a manner allowing their translational motion in directions which can change the gap size. Additionally, a centering mechanism insures the distance moved by each plate is equal.

16 Claims, 8 Drawing Sheets

FOOD HOLDER FOR SLICING FOOD INTO TWO PIECES

This application is based on application No. 9-356957 filed in Japan on Dec. 25, 1997, the content of which incorporated hereinto by reference.

BACKGROUND OF THE INVENTION

This invention relates to a food holder used primarily to slice a bagel, which is a donut-shaped bread, into two slices.

Donut-shaped bagels are sliced into two pieces to sandwich foods such as cheese, jam, etc. between the slices. This is not limited to bagels, and thickly cut loaf-bread, etc. can also be sliced into two pieces. Further, this is not limited to bread, as other foods can also be sliced into two pieces.

For this application, a food holder, which holds a food item from both sides, is used. The food holder holds the food in an upright position by sandwiching it between two vertical plates. Knife guides are provided on both sides of the gap between the parallel vertical plates to slice food held between the vertical plates into pieces of equal thickness. The knife guides are provided with guide slits for moving a knife or other bladed utensil vertically. In this food holder, food held in the gap between the parallel vertical plates is cut vertically into slices of equal thickness by moving a knife or other blade through the guide slits.

This configuration of food holder can accurately slice food, which is the same thickness as the width of the gap between vertical plates, into slices of equal thickness. However, since the size of the gap between vertical plates is fixed and cannot be adjusted in this type of food holder, it has the drawback that it cannot accurately slice food which is narrower than the gap. This is because space is created between the food and the vertical plates, and the food cannot be held in the correct position without moving. Further, this food holder also has the drawback that it cannot slice food which is wider than the gap between vertical plates. This is because use wider food cannot be inserted into the gap between vertical plates.

To eliminate these drawbacks, a food holder with vertical plates that can be adjusted to change the gap size between the plates has been marketed. This food holder has two vertical plates connected to a base in a manner allowing the vertical plates to slide laterally. The vertical plates can slide and the gap between the plates can be adjusted. When wide foods are sliced, the two vertical plates are mutually separated to make the gap between them wider.

In this type of food holder, the vertical plates can be adjusted according to width of the food to hold that food between the plates, a knife or other blade can be moved through the guide slits, and the food can be sliced into two pieces. However, this type of food holder has the drawback that foods cannot be accurately cut into slices of equal thickness. This is because the two vertical plates slide independently, and when they are moved the position of the guide slits in the knife guides strays from the center of the gap between the parallel vertical plates.

The present invention was developed with the object of eliminating this drawback. Thus it is a primary object of the present invention to provide a food holder for slicing food into two pieces, which can accurately slice food into pieces of the same thickness with extremely simple operation and regardless of the food thickness.

The above and further objects and features of the invention will more fully be apparent from the following detailed description with accompanying drawings.

SUMMARY OF THE INVENTION

The food holder of the present invention is provided with two vertical plates to hold a food item, a base connecting the two vertical plates, and knife guides to guide a knife for slicing the food. The vertical plates are positioned parallel and opposing each other, and a gap is established between the plates where food is held. The vertical plates are mounted on the base in a vertical orientation. The knife guides are positioned at both ends of the gap established by the two vertical plates, are mounted on the base in a vertical orientation, and have guide slits extending in the vertical direction.

This food holder is configured for moving a knife through the guide slits of the knife guides to cut food held in the gap between the two vertical plates into two pieces at the center of the food.

Further, the two vertical plates of the food holder are connected to the base in a manner allowing their translations motion in directions to change the size of the gap between them, and a centering mechanism insures the two vertical plates move equal distances. The guide slits of the knife guides are positioned at the center of the gap formed between the vertical plates which are moved via the centering mechanism.

This configuration of food holder car accurately slice food into pieces of the same thickness with extremely simple operation and regardless of the food thickness. This is because the two vertical slates connect to the base in a manner allowing their translational motion, and the two vertical plates move equal distances due to the centering mechanism. Consequently, this food holder can accurately slice bagels (or other foods) of different widths into slices with the same thickness.

DETAILED DESCRIPTION OF THE INVENTION

Figure 1:
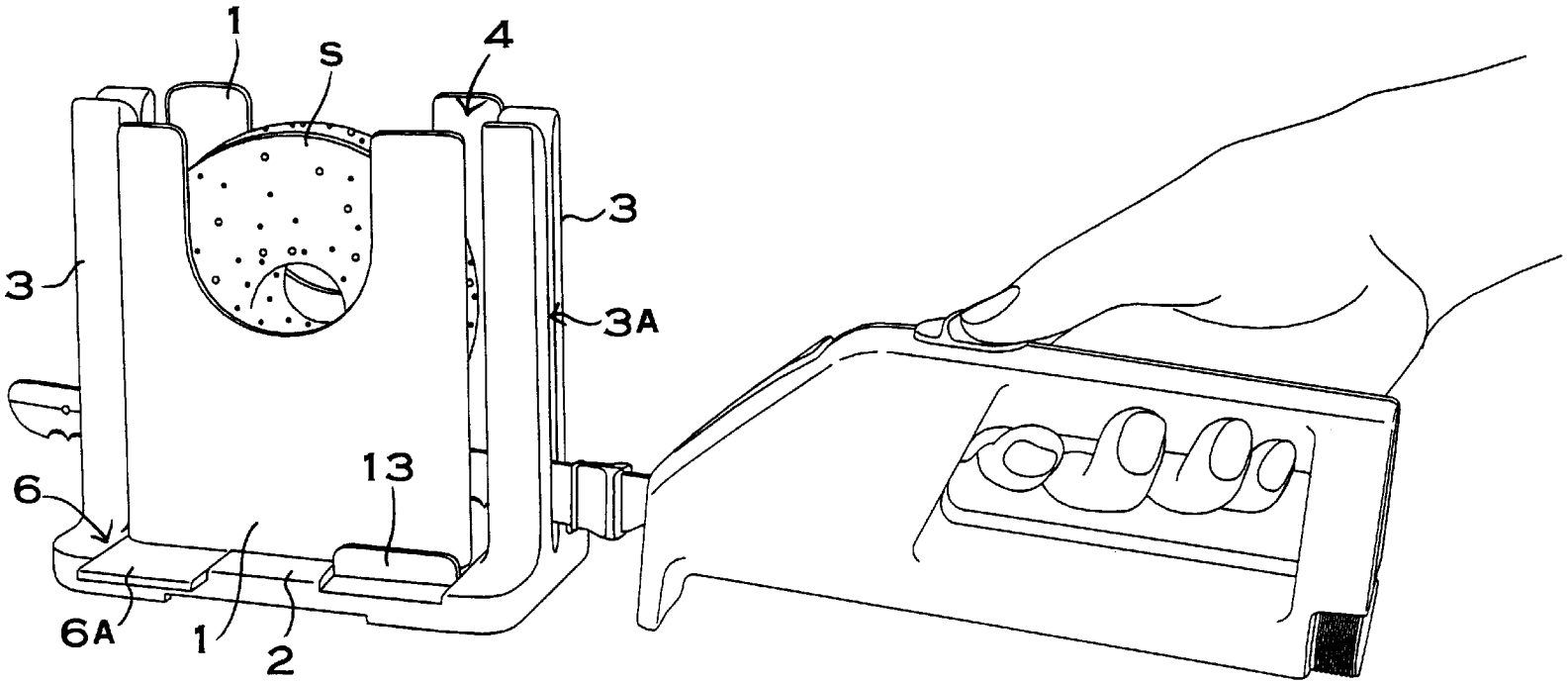
FIG. 1 is an oblique view showing a bagel being sliced using the food holder of the present invention.

Turning to FIG. 1, a food holder for slicing food into two pieces is shown in use. The food holder is primarily used for slicing bagels, which are a type of bread, but the food for slicing is not limited to bagels.

The food holder shown in FIG. 1, which holds food S for slicing into two pieces, is provided with a base 2, two vertical plates 1, knife guides 3, and a centering mechanism which moves the vertical plates 1 equal distances.

Figure 2:
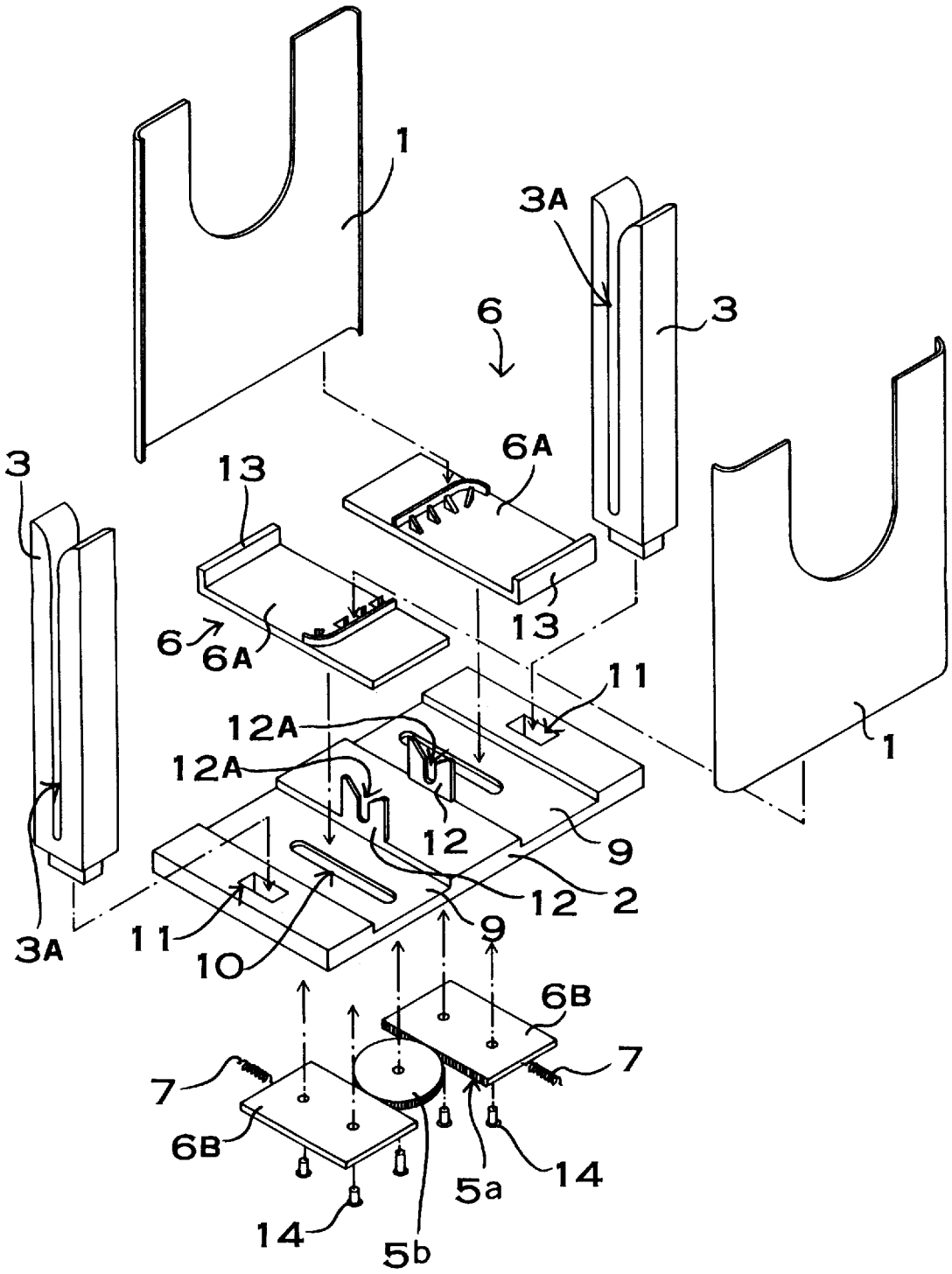
FIG. 2 is an exploded perspective view of the food holder shown in FIG. 1.

The base 2 is formed from plastic into a rectangular shape and, as shown in the exploded oblique view of FIG. 2, is provided with two rows of slide grooves 9 for moving the vertical plates 1. The slide grooves 9 are parallel and extend laterally across the base 2. Laterally extending slots 10 are provided through the base 2 at the center regions of the slide grooves 9. The slots 10 extend parallel to the slide grooves 9 in the long direction of the grooves. Further, connection openings 11 are made through both ends of the base 2 for insertion and attachment of the knife guides 3. Finally, food supports 12 are formed as a single unit with the base 2 at the center region of the base.

Figure 3:
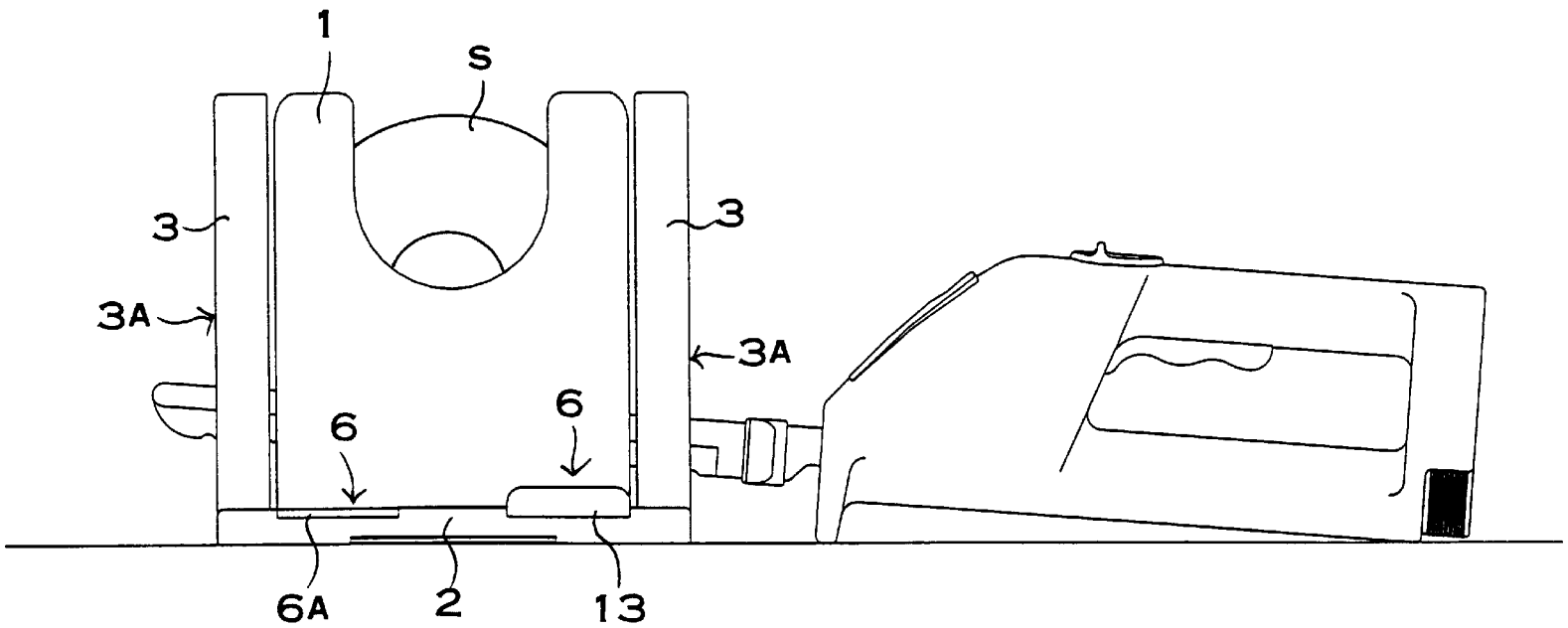
FIG. 3 is a side view showing food being sliced with the food holder shown in FIG. 1.
Figure 4:
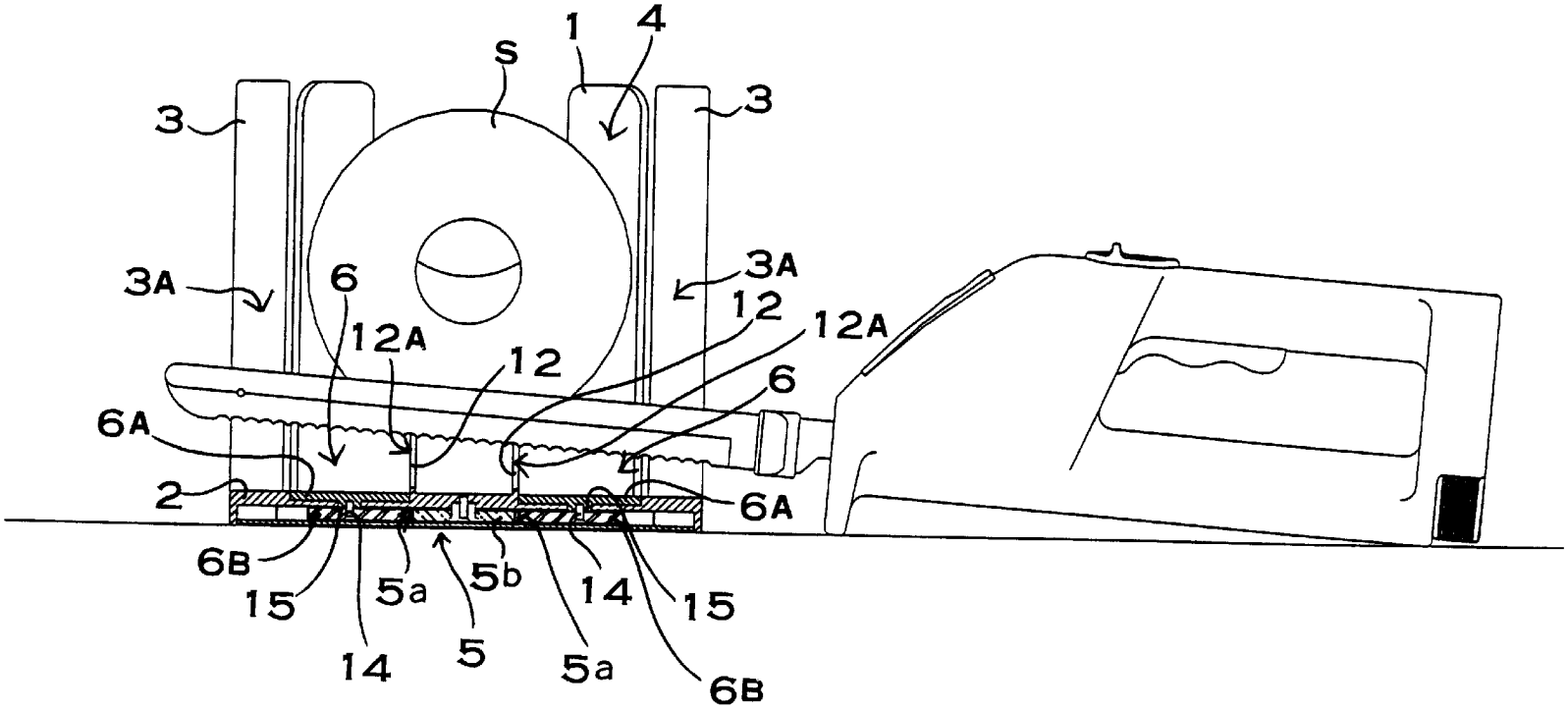
FIG. 4 is a cross-section view showing food being sliced with the food holder shown in FIG. 1.

The food supports 12 have the form of two plates provided with knife slits 12A to allow knife insertion. The two food supports 12 are fixed to the upper surface of the base 2 adjacent to the slide grooves 9 and perpendicular to the vertical plates 1. The food supports 12 are fixed to the base 2 in a position causing guide slits 3A in the knife guides 3 and the knife slits 12A to all lie in the same plane. This is because, as shown in FIGS. 3 and 4, a straight knife for cutting the food S is inserted through both the knife guide 3 guide slits 3A and the food support 12 knife slits 12A. In a food holder which holds food S in a gap 4 between vertical plates 1 on food supports 12 above the surface of the base 2, food is completely cut into two pieces without the knife touching the base 2.

The vertical plates 1 are disposed vertically in mutual opposition and parallel to each other. Food S is sandwiched between the vertical plates 1 and held in the gap 4 formed between the vertical plates 1. The two vertical plates 1 connect to the base 1 via slide plates 6 to allow translational motion of the vertical plates 1 in directions which change the size of the gap 4 between the plates. In the food holder of FIG. 2, the slide plates 6 are made up of main slide plates 6A, which slide along the upper surface of the base 2, and attachment plates 6B which slide along the bottom surface of the base 2 and sandwich the base. The vertical plates 1 and the main slide plates 6A can be formed from plastic as single units or they can be formed separately and attached.

Figure 5:
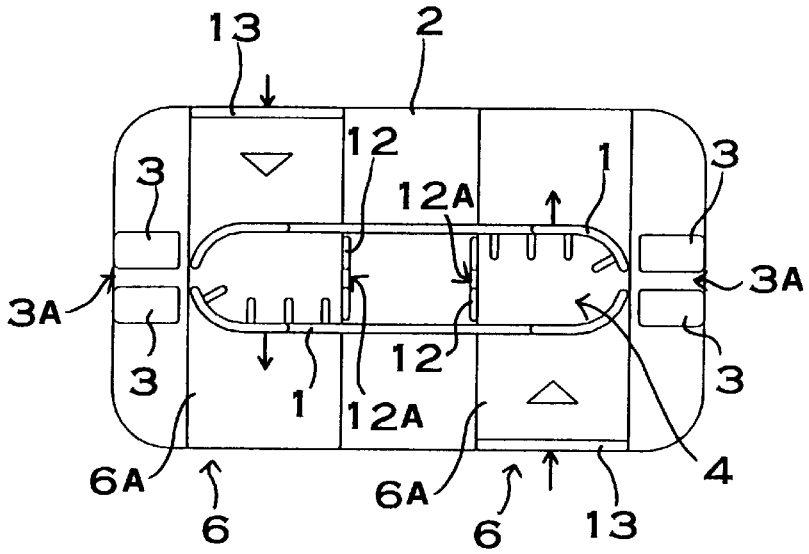
FIG. 5 is a plan view showing the food holder shown in FIG. 1 with its vertical plates close together.
Figure 6:
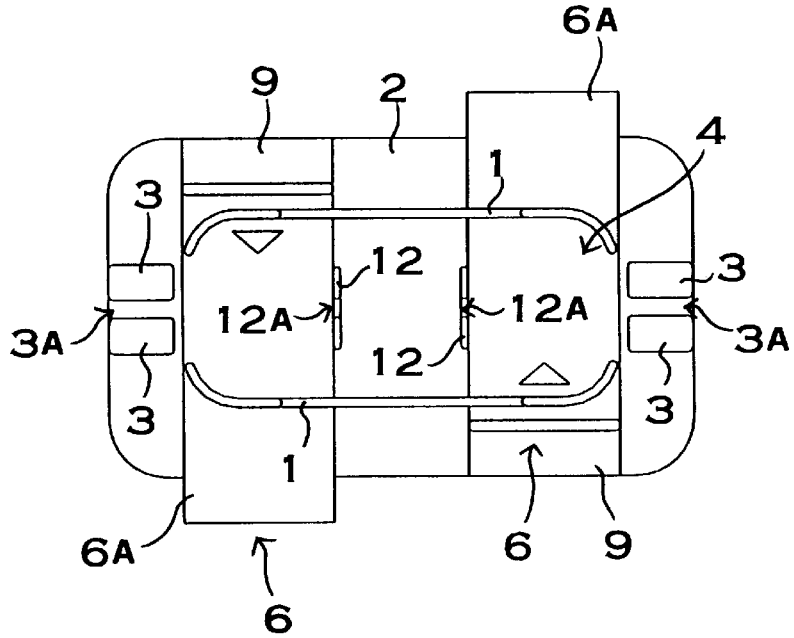
FIG. 6 is a plan view showing the food holder shown in FIG. 1 with its vertical plates separated.

The vertical plates 1 are fixed so as to be perpendicular to the main slide plates 6A. Each of the two vertical plates 1 are attached separately to a main slide plate 6A. Each one of the main slide plates 6A is connected to a vertical plate 1 on one side but is not connected to the vertical plate 1 on the other side. As shown in FIGS. 5 and 6, a main slide plate 6A moves together with its perpendicularly attached vertical plate 1 in a slide groove 9, but it moves separately and in the opposite direction from the vertical plate 1 which is not attached. FIG. 5 is a plan view of the two vertical plates 1 close together making the gap 4 between the plates narrow. FIG. 6 shows the vertical plates 1 and main slide plates 6A moved in the directions shown by the arrows making the gap 4 between the vertical plates 1 wider. In the food holder shown in these and other Figures, the main slide plate 6A on the right side is connected to the upper vertical plate 1, and the main slide plate 6A on the left side is connected to the lower vertical plate 1.

A vertical plate 1 is connected to a main slide plate 6A in an orientation that is perpendicular to the sliding direction of the main slide plate 6A. Further, the vertical plates 1 shown in the figures have both ends curved slightly inward to allow food to be held with certainty.

Figure 7:
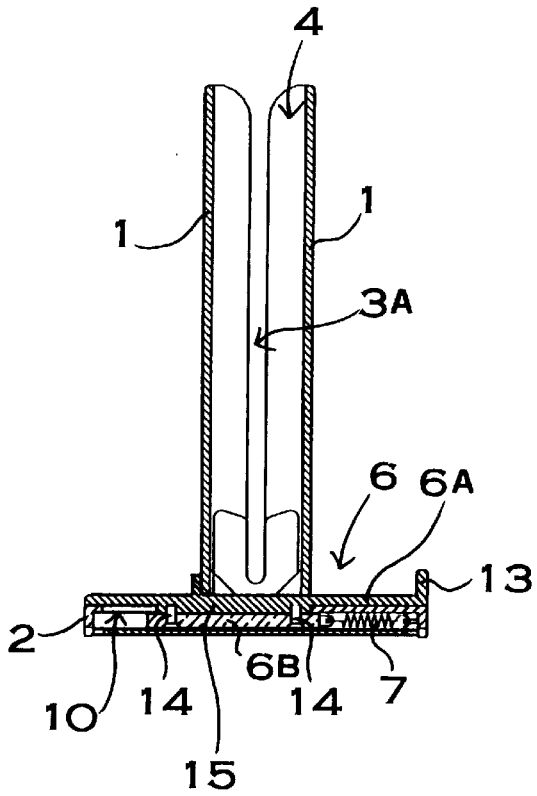
FIG. 7 is a vertical cross-section end view of the food holder shown in FIG. 1.

In the food holder shown in the exploded oblique view of FIG. 2 and the vertical cross-section of FIG. 7, the vertical elates 1 and the main slide plates 6A are formed separately and attached together. An attachment section is formed as a single piece with each main slide plate 6A for inserting of the bottom edge of a vertical plate 1 and securing the vertical plate 1 in a fixed position on the main slide plate 6A. The attachment section shown in the FIGS. 2 and 7 is made up of a periphery rib formed in a shape conforming to the outer surface of a vertical plate, and a plurality of support projections which support the inner surface of the vertical plate. The bottom edge of a vertical plate 1 inserts into the space between the periphery rib and the support projections for attachment to a main slide plate 6A. The bottom edge of a vertical plate 1 is wedged between a periphery rib and support projections for connection at a fixed position.

The main slide plates 6A are mounted in the slide grooves 9 in a manner which allows them to slide. Consequently, the width of each main slide plate 6A is made slightly narrower than the width of each slide groove 9. Further, in the food holder shown in the figures, the main slide plates 6A are formed with a thickness approximately equal to the depth of the slide grooves 9, and the upper surfaces of the main slide plates 64 lie approximately in the same plane as the upper surface of the base 2.

For convenient operation when the vertical plates 1 are moved along the slide grooves 9, one end of each main slide plate 6A is formed with an upward bend to provide a handle 13. When the handles 13 are pushed, the main slide plates 6A and the vertical plates 1 move along the base 2, and the gap 4 between the vertical plates 1 becomes wider.

The main slide plates 6A are connected to attachment plates 6B which slide along the bottom surface of the basis 2. The attachment plates 6B slide along the base 2 in an orientation preventing the vertical plates 1 from falling. The attachment plates 6B are connected to the main slide plates 6A through the laterally extending slots 10 via set screws 14. Connecting bars 15 projecting from the bottom surfaces of the main slide plates 6A are formed as single units with the main slide plates 6A. The connecting bars 15 make contact with the upper surfaces of the attachment plates 6B. The bottom edges of the connecting bars 15 contact the upper surfaces of the attachment plates 6B thereby determining the spacing between the main slide plates 6A and the attachment plates 6B. The spacing between the main slide plates 6A and attachment plates 6B is set to sandwich the base 2 and allow the plates to slide. The set screws 14 are inserted into screw roles provided in the elliptical shaped end regions of each connecting bar 15. The set screws 14 pass through the attachment plates 6B and their tips are screwed into the connecting bar segments of the main slide plates 6A. The attachment plates 6B are connected to the main slide plates 6A by these set screws 14. Finally, the width of the connecting bars 15 is made slightly smaller than the width of the laterally extending slots 10 in the base 2 to allow movement of the connecting bars within the slots.

The knife guides 3 are positioned on both sides of the gap 4 created between the two vertical plates 1, and mounted so as to be perpendicular to the base 2. The knife guides 3 have guide slits 3A extending vertically, and the knife guides 3 are mounted on the base 2 so that the guide slits 3A are positioned at the center of the gap 4 between the vertical plates 1. The width of the guide slits 3A allows insertion of a knife such as an electric kitchen knife.

Figure 8:
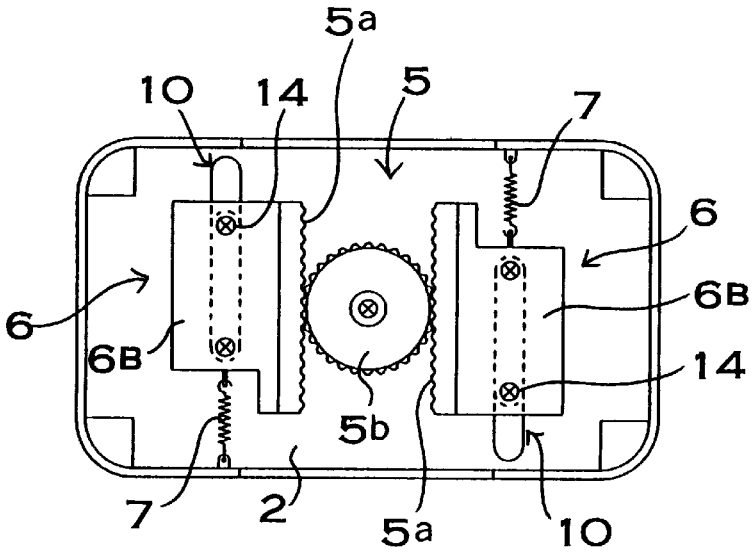
FIG. 8 is a bottom view showing one embodiment of the centering mechanism for the food holder shown in FIG. 1.

The centering mechanism makes the distance moved by the two vertical plates 1 equal. The food holder of FIG. 8 is provided with gear mechanism for a centering mechanism 5. This centering mechanism 5 is configured with racks 5*a* provided on opposing edges of the slide plates 6 which connect to the two vertical plates, and a synchronous gear 5*b* which meshes with the two racks 5*a* in a rack and pinion arrangement. The racks 5*a* are established on opposing edges of the attachment plates 6B, which are components of the slide plates 6. The racks 5*a* on opposing edges of the attachment plates are parallel to each other and mesh with the gear 5*b*. The gear 5*b* is mounted on the bottom surface of the base 2 in a manner allowing it to rotate. When one of the slide plates 6 is moved, the gear 5*b* rotates. As a result of the rack and pinion arrangement with the gear 5*b*, the two slide plates 6 are controlled so as to move the same distance. Consequently, the two vertical plates connected to the slide plates 6 are also controlled in the same manner by the racks 5*a* and synchronous gear 5*b*.

In the slide plates of FIG. 8, flexible materials 7 are connected to the attachment plates 6B. The flexible materials 7 are tension springs which pull resiliently on the attachment plates 6B. The directions which the flexible materials 7 pull the attachment plates 6B Ere such that the gap 4 between the vertical plates is narrowed. When the slide plates 6 are moved to widen the gap 4 between the vertical plates and a food item is inserted, the flexible materials 7 force the vertical plates in a direction which sandwiches the food and holds it tightly. For this reason the user does not need to methodically push the vertical plates tightly against the food. Therefore, his food holder has the characteristic that foods of various thicknesses can be inserted in the gap 4 between vertical plates, the vertical plates can hold the food tightly without creating space between the food and the plates, and the food can be accurately cut into slices of the same thickness.

Figure 9:
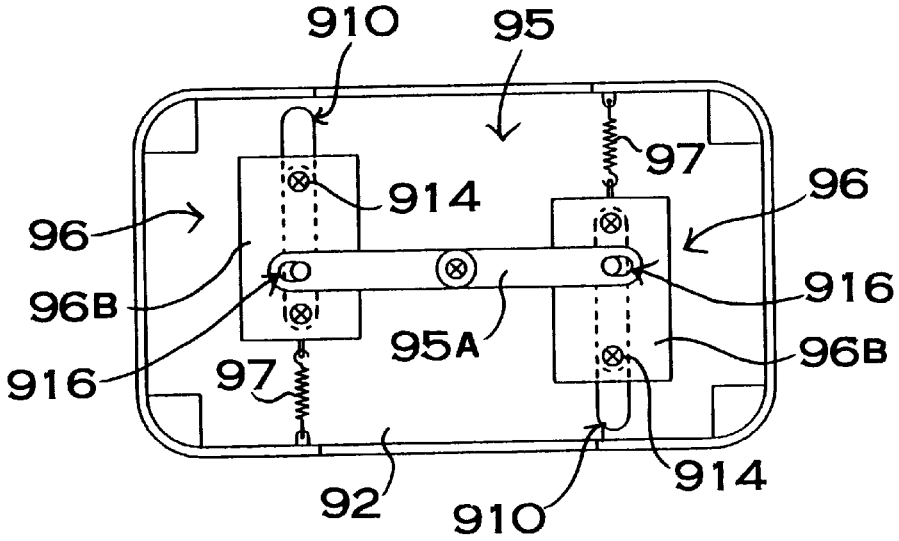
FIG. 9 is a bottom view of a food holder showing another embodiment of the centering mechanism.

Turning to FIG. 9, the food holder of the present invention can also have a link mechanism as the centering mechanism 95, where the distance moved by the vertical plates is made equal by a link 95A. In this centering mechanism 95, one end of the link 95A is connected to the vertical plate via the slide plate 96 attachment plate 96B and the other end is connected to the other vertical plate via the other slide plate 96 attachment plate 96B. The center of the link 95A is connected to the base 92 via a rotation shaft, thereby allowing rotation within the horizontal plane. Lengthwise extending slide openings 91E are provided at both ends of the link 95A, and pins that are fixed to the attachment plates 96B pass through these slide openings 916 to connect the link 95A wits the attachment plates 96B. In this centering mechanism 95, when an attachment plate 96B on one side moves, the link 95A inclines, and the attachment plate 96B on the other side is forced to move the same distance. Consequently, the two vertical plates are moved the same distance via the link 95A.

As shown in FIG. 9, flexible material, 97 connect with the attachment plates 96B in this food holder as well, or although not illustrated, flexible material can connect with the link, to resiliently hold food between the vertical plates. Further, as shown in FIG. 10, the food holder may also have flexible material 107 which is a coil spring.

Figure 10:
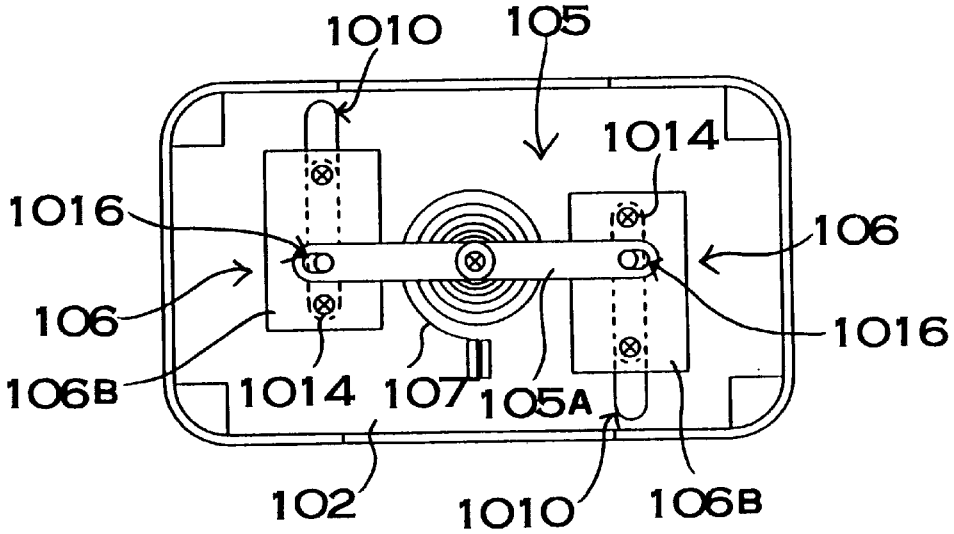
FIG. 10 is a bottom view of a food holder showing another embodiment of the centering mechanism.

In the food holder of FIG. 10, the center of the flexible material 107 which is a coil spring is connected to the center region of the link 105A, the link 105A is caused to rotate by the resilience of the coil spring, and food is held in a resilient manner by the vertical plates. The flexible materials 97 and 107 shown in FIGS. 9 and 10 apply forces in directions to resiliently hold food between the vertical plates in the same manner as the flexible materials 7 of FIG. 8.

Figure 11:
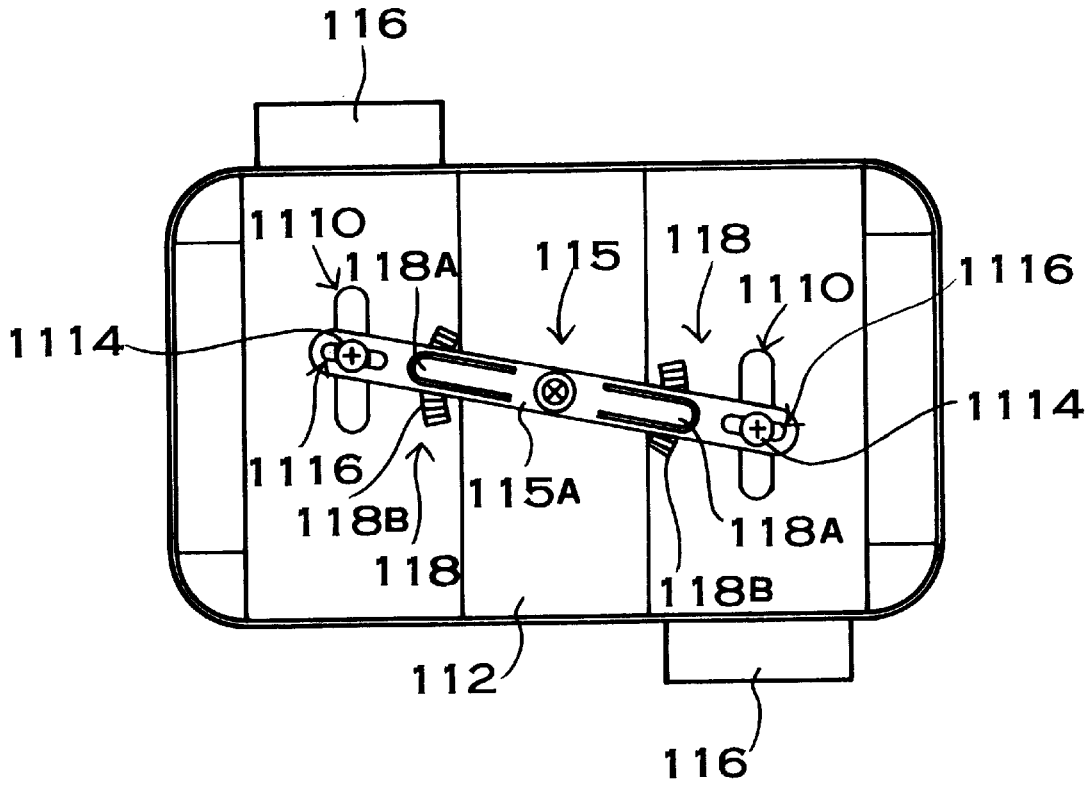
FIG. 11 is a bottom view showing another embodiment of the food holder of the present invention.

Further, as shown in FIG. 11, the attachment plates disposed on the bottom surface of the base 112 may be omitted in a food holder with a link centering mechanism. In this food holder, the link 115A which is connected to the slide plates 116 via set screws 1114 also serves as the attachment plates, and the set screws 1114 which are screwed into the slide plates 116 also serve as the pins which pass through the slide openings 1116 in the link 115A. The set screws 1114 have heads each with an outside diameter that is larger than the slide openings 1116 in the link 115A so that the set screw heads cannot pass through the slide openings 1116. The set screws 1114 pass through the slide openings 1116 in the link 115A and through the laterally extending slots 1110 in the base 112 to screw into the slide plates 116 and connect the link 115A to the slide plates 116. Since the slide plates 116 are connected to the link 115A at the bottom surface of the base 112, the slide plates 116 can move translationally along the base 1 12 without becoming separated from the base 112. This configuration of food holder has the characteristic that translational motion of the slide plates can be achieved with a simple mechanism, and the number of parts can be reduced for inexpensive production in quantity.

Finally, the food holder shown in FIG. 11 is provided with a ratchet mechanism 118 for the link 115A. The link 115A is provided with U-shaped grooves which establish flexible arms 118A The flexible arms 118A have ratchet projections (not illustrated) on the surfaces facing the base 112. The base 112 is provided with ratchet serrations 118B on its bottom surface facing the ratchet projections. The flexible arms 118A resiliently press the ratchet projections into the serrations 118B of the base 112. When the vertical plates are moved in this type of food holder, the ratchet projections on the flexible arms 118A are pressed into serrations 118B on the base 112 resulting in ratcheted movement. Consequently, when the vertical plates are moved in this type of food holder, movement can be stopped at specified detent positions. Therefore, this food holder has the characteristic that food of a given thickness can be conveniently sliced.

Note that the lower order digits of part numbers in FIG. 9 without the high order digit 9, in FIG. 10 without the high order digits 10, and in FIG. 11 without the high order digits 11, specify the same parts as the part numbers shown in FIGS. 1 through 8. For example, part number 95 in FIG. 9, part number 105 in FIG. 10, and part number 115 in FIG. 11 all refer to the same centering mechanism shown as part number 5 in FIGS. 1 through 8.

As this invention may be embodied in several forms without departing from the spirit or essential characteristics hereof, the present embodiments are therefore illustrative and not restrictive, since the scope of the invention is defined by the appended claims rather than by the description preceding them, and all changes that fall within the metes and bounds of the claims or equivalence of such metes and bounds thereof are therefore intended to be embraced by the claims.

What is claimed is:

1. A food holder for slicing food into two pieces, said food holder comprising:

a base having a first slide groove, a second slide groove, and a plurality of connection openings;

a first vertical plate connected to said base in a vertical orientation, said first vertical plate being movably supported in said first slide groove;

a second vertical plate opposing said first plate and connected to said base in a vertical orientation, said second plate being movably supported in said second slide groove, wherein said first and second vertical plates define an adjustable gap between opposing faces thereof;

a centering mechanism operable to cause equidistant movement of said first and second vertical plates toward and away from each other on said base; and knife guides received in said connection openings in said base, respectively, so as to be positioned at both ends of the gap defined between said first and second vertical plates, wherein each of said knife guides has a vertically extending guide slit, and said connections opening are located in said base so that said guide slits are aligned with a center of the gap defined between said first and second vertical plates.

2. A food holder as claimed in claim 1, further comprising first and second slide plates slidably disposed in said first and second slide grooves, respectively.

3. A food holder as claimed in claim 2, wherein said first and second vertical plates are movable relative to said base due to movement of said first and second slide plates in said first and second slide grooves, respectively.

4. A food holder as claimed in claim 2, wherein said first slide plate comprises a first main slide plate slidably received in said first slide groove and a first attachment plate slidably contacting a bottom surface of said base, and said second slide plate comprises a second main slide plate slidably received in said second slide groove and a second attachment plate slidably contacting the bottom surface of said base.

5. A food holder as claimed in claim 4, wherein said first main slide plate and said first attachment plate are connected via a first slot through said base, and said second main slide plate and said second attachment plate are connected via a second slot through said base.

6. A food holder as claimed in claim 4, wherein:

said first main slide plate includes a connecting bar projecting through said base and contacting an upper surface of said first attachment plate in order to set a spacing between said first main slide plate and said first attachment plate; and said second main slide plate includes a connecting bar projecting through said base and contacting an upper surface of said second attachment plate in order to set a spacing between said second main slide plate and said second attachment plate.

7. A food holder as claimed in claim 4, wherein each of said first and second main slide plate has an upwardly bent portion to provide a handle.

8. A food holder as claimed in claim 1, wherein said centering mechanism comprises a ratchet mechanism, and said first and second vertical plates are connected to said base via said ratchet mechanism.

9. A food holder as claimed in claim 1, wherein said centering mechanism comprises a link member connected to said base via a rotation shaft, said link member having a first end connected to said first vertical plate and a second end connected to said second vertical plate.

10. A food holder as claimed in claim 9, further comprising a coil spring connected to a center region of said link member to bias said link member in a rotary direction that will cause the gap between said first and second vertical plates to become more narrow.

11. A food holder for slicing food into two pieces, said food holder comprising:

a base;

a first plate connected to said base in a vertical orientation, said first plate being slidably supported on said base;

a second plate opposing said first plate and connected to said base in a vertical orientation, said second plate being slidably supported on said base, wherein said first and second plates are positioned so as to define an adjustable gap between opposing faces thereof;

a centering mechanism operable to cause equidistant movement of said first and second plates toward and away from each other on said base;

knife guides mounted on said base so as to be positioned at both ends of the gap defined between said first and second plates, each of said knife guides having a vertically extending guide slit, wherein said knife guides are mounted on said base so that the guide slits are aligned with a central plane at a center of the gap defined between said first and second plates; and a plurality of food supports mounted on said base and having knife slits aligned in the same plane as said guide slits of said knife guides.

12. A food holder for slicing food into two pieces, said food holder comprising:

a base;

a first plate connected to said base in a vertical orientation, said first plate being slidably supported on said base, wherein said first plate has opposite edge portions that are inwardly curved;

a second plate opposing said first plate and connected to said base in a vertical orientation, said second plate being slidably supported on said base, wherein said first and second plates are positioned so as to define an adjustable gap between opposing faces thereof, and wherein said second plate has opposite edge portions that are inwardly curled;

a centering mechanism operable to cause equidistant movement of said first and second plates toward and away from each other on said base; and knife guides mounted on said base so as to be positioned at both ends of the gap defined between said first and second vertical plates, each of said knife guides having a vertically extending guide slit, wherein said knife guides are mounted on said base so that said guide slits are aligned at a center of the gap defined between said first and second plates.

13. A food holder for slicing food into two pieces, said food holder comprising:

a base;

first and second slide plates slidably supported on said base;

a first vertical plate connected to said first slide plate in a vertical orientation relative to said base;

a second vertical plate opposing said first vertical plate and connected to said second slide plate in a vertical orientation relative to said base, wherein an adjustable gap is defined between opposing faces of said first and second vertical plates;

first and second racks connected to opposing edges of said first and second slide plates, respectively;

a synchronous gear rotatably mounted on said base, said synchronous gear being in mesh with said first and second racks in a rack and pinion arrangement for moving said first and second plates in opposite directions; and knife guides mounted on said base so as to be positioned at both ends of the gap defined between said first and second vertical plates, each of said knife guides having a vertically extending guide slit, wherein said knife guides are mounted on said base so that said guide slits are aligned at a center of the gap defined between said first and second vertical plates.

14. A food holder as claimed in claim 13, further comprising resilient means for resiliently biasing said first and second vertical plates in a direction which narrows the gap between said vertical plates.

15. A food holder as claimed in claim 14, wherein said resilient means comprises:

a first tension spring connected to said first slide plate and said base; and a second tension spring connected to said second slide plate and said base.

16. A food holder as claimed in claim 13, further comprising:

a first tension spring connected to said first slide plate and said base; and a second tension spring connected to said second slide plate and said base, wherein said first and second tension springs urge said first and second vertical plates, respectively, in a direction which narrows the gap between said first and second vertical plates.

* * * * *